US006913518B2

(12) United States Patent
Chen et al.

(10) Patent No.: US 6,913,518 B2
(45) Date of Patent: Jul. 5, 2005

(54) PROFILE CONTROL PLATEN

(75) Inventors: Hung Chih Chen, San Jose, CA (US); Steven M. Zuniga, Soquel, CA (US); Charles C. Garretson, San Jose, CA (US); Thomas H. Osterheld, Mountain View, CA (US); Sen-Hou Ko, Cupertino, CA (US); Mohsen Salek, Saratoga, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 10/430,912

(22) Filed: May 6, 2003

(65) Prior Publication Data

US 2004/0224615 A1 Nov. 11, 2004

(51) Int. Cl.[7] ..... B24B 7/22

(52) U.S. Cl. ..... 451/41; 451/504

(58) Field of Search ..... 451/921, 41, 57, 451/527, 530, 533, 524, 525, 495

(56) References Cited

U.S. PATENT DOCUMENTS

| | | | | |
|---|---|---|---|---|
| 3,149,443 | A * | 9/1964 | Bergmann et al. | 451/514 |
| 5,435,772 | A | 7/1995 | Yu | |
| 5,558,563 | A * | 9/1996 | Cote et al. | 451/41 |
| 5,762,536 | A | 6/1998 | Pant et al. | |
| 5,800,248 | A | 9/1998 | Pant et al. | |
| 5,860,851 | A * | 1/1999 | Beppu et al. | 451/505 |
| 5,931,719 | A * | 8/1999 | Nagahara et al. | 451/41 |
| 6,267,659 | B1 | 7/2001 | Chen et al. | |

FOREIGN PATENT DOCUMENTS

| | | | | |
|---|---|---|---|---|
| BE | 0744009 | * | 7/1970 | 451/526 |

* cited by examiner

*Primary Examiner*—Robert A. Rose
(74) *Attorney, Agent, or Firm*—Fish & Richardson

(57) ABSTRACT

A platen for chemical mechanical polishing of a substrate includes a surface upon which a polishing pad can be placed, a support structure, and a controller. The surface has a first region and a second region and is operable to exert force against the polishing pad during polishing. The support structure is located beneath the second region and is operable to cause the second region to exert more force than the first region. The controller is operable to adjust the amount of force that is exerted by the second region.

15 Claims, 4 Drawing Sheets

PROFILE CONTROL PLATEN

BACKGROUND

The present invention relates generally to chemical mechanical polishing of substrates.

Integrated circuits are typically formed on substrates, particularly silicon wafers, by the sequential deposition of conductive, semi-conductive or insulating layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar outer surface presents a problem for the integrated circuit manufacturer. If the outer surface of the substrate is non-planar, then a photo-resist layer placed thereon is also non-planar. A photo-resist layer is typically patterned by a photolithographic apparatus that focuses a light image onto the photo-resist. If the outer surface of the substrate is sufficiently non-planar, the maximum height difference between the peaks and valleys of the outer surface may exceed the depth of focus of the imaging apparatus. Then it will be impossible to properly focus the light image onto the entire outer surface. Therefore, there is a need to periodically planarize the substrate surface to provide a flat surface for photolithography.

Chemical mechanical polishing (CMP) is one accepted method of planarization. This planarization method typically requires that the substrate be mounted on a carrier or polishing head. The exposed surface of the substrate is then placed against a rotating polishing pad. A polishing slurry, including an abrasive and at least one chemically-reactive agent, may be supplied to the polishing pad to provide an abrasive chemical solution at the interface between the pad and the substrate. The carrier head provides a controllable load, i.e., pressure, on the substrate to push it against the polishing pad. In addition, the carrier head may rotate to provide additional motion between the substrate and polishing surface. The interaction of the polishing pad and abrasive particles with the reactive sites on the substrate results in polishing.

An effective CMP process generates a substrate surface that is finished (lacks small-scale roughness) and flat (lacks large-scale profile). The polishing finish and flatness are determined in part by the force pressing the substrate against the pad and in part by the relative velocities of the substrate and the pad. However, a variety of factors, including non-uniform velocities, non-uniform slurry distribution and distortions in the polishing pad can cause the rate of polishing to vary spatially, resulting in non-uniform polishing of a semiconductor substrate surface.

SUMMARY OF THE INVENTION

In one aspect, the invention is directed to a chemical mechanical polishing apparatus comprising a platen that includes a surface upon which a polishing pad can be placed, a support structure, and a controller. The surface has a first region and a second region and is operable to exert force against the polishing pad during polishing. The support structure is located beneath the second region and is operable to cause the second region to exert more force than the first region. The controller is operable to adjust the amount of force that is exerted by the second region.

Particular implementations can include one or more of the following features. The support structure is a mechanical structure that is operable to position the second region such that the second region is elevated with respect to the first region. The controller is operable to adjust the height at which the mechanical structure positions the second region.

The support structure is a pressurized chamber and the controller is a valve operable to adjust the amount of pressure in the chamber. The pressure within the chamber is created by adding fluid into the chamber. The fluid is gaseous. The fluid is air. The valve is operable to control the amount of fluid that is added or released from the chamber. The second portion is formed of a flexible membrane and the valve is operable to allow enough fluid to enter the chamber such that the pressure within the chamber causes the flexible membrane to become distended.

The second region is a groove and the support structure is a pressurized chamber formed within the groove when the polishing pad is placed over the groove. The controller is a valve operable to adjust the amount of pressure in the chamber. The platen is configured to rotate during polishing. The surface of the platen is circular in shape. The polishing pad has edges that are attached to the platen.

In another aspect, the invention is directed to a method for chemical mechanical polishing that calls for placing a polishing pad on a platen, the platen having a first surface region and a second surface region; using the platen to exert force against the polishing pad during polishing; and adjusting the force that is exerted by the second surface region such that the second region exerts more force than the first region.

Particular implementations can include one or more of the following features. Adjusting the amount of force includes adjusting the amount of pressure within a pressure chamber located beneath the second surface region. The method further calls for placing a substrate on the polishing pad; and adjusting the placement of the substrate relative to the second surface region.

Particular implementions of the invention can realize one or more of the following advantages. The invention can provide improved control of polishing rates across the substrate surface (ie., polishing profile control). The backside of the polishing pad can be pressurized and the pressure can be applied at selected regions of the polishing pad. The location of the selected pressurized regions relative to the substrate can be varied by varying the location of the substrate relative to the polishing pad. More pressure can be applied in regions of the substrate where the polishing rate is lower. The polishing pad can transfer pressure to the front surface of the substrate substantially without distortion, e.g., spreading, of the shape or size of the selected region.

The details of one or more embodiments of the invention are set forth in the accompanying drawings and the description below. Other features and advantages of the invention will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
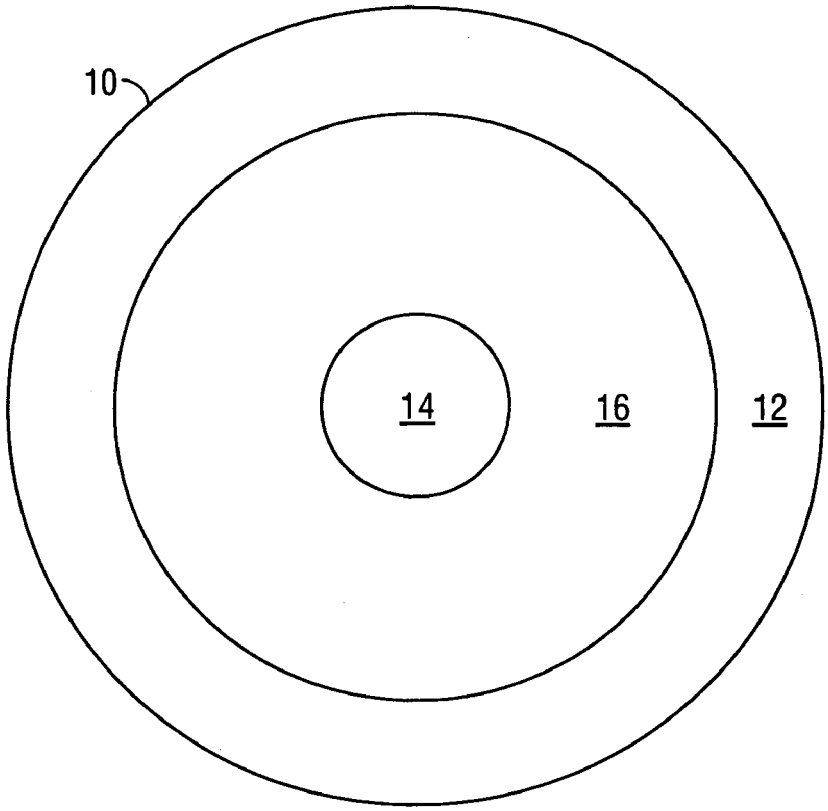
FIG. 1 is a schematic top view of a platen.

Referring to FIG. 1, a chemical mechanical polishing apparatus includes a rotatable platen 10 for supporting a polishing pad (not shown). In other respects, the CMP apparatus can be configured as described in U.S. Pat. No. 5,738,574, the entire disclosure of which is incorporated by this reference.

The surface of the platen 10 can include an outer region 12, a center region 14, and a middle region 16 that lies in between the outer region 12 and center region 14. In one implementation, the surface of the platen 10 can be shaped as a circle. The center 14, middle region 16, and outer 12 regions can represent radial regions of the circular surface, with the circular center region 14 being closest to the center, the annular outer region 12 being furthest from the center and the annular middle region 16 being between the annular outer 12 and the circular center 14. The amount of pressure that the platen exerts against the polishing pad can vary among regions of the platen. A given region, for example, the middle region 16, can exert more pressure than another region. The difference in pressure between regions can be implemented, for example, by varying the height of a given region relative to other regions of the platen.

Figure 2:
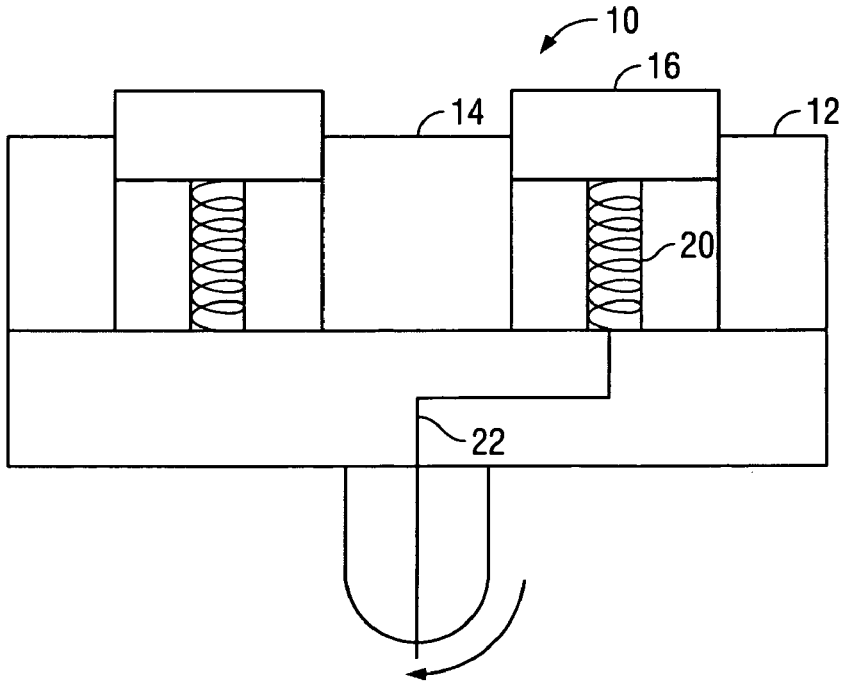
FIG. 2 is a schematic cross-sectional side view of a platen with mechanically adjustable surface.

In one implementation, shown in FIG. 2, the platen 10 includes a base 22 that supports the center region 14, middle region 16 and outer region 12. In addition, the platen 10 includes an actuator 20, such as an electric or pneumatic actuator, that can extend or contract to adjust the height of a portion of the platen. For example, the middle region 16 of the platen can be physically separable from the surrounding regions and can rest upon or be attached to the actuator 20 so that as the actuator 20 extends or contracts, the middle region 16 is raised or lowered accordingly. The actuator 20 can be connected by a control line 22 to unillustrated control elements, such as pneumatic or electronic controllers. The actuator 20 can be configured to position the middle region 16 such that the middle region 16 is elevated with respect to the adjacent regions 12, 14. The difference in height between the middle region 16 and the adjacent regions 12, 14 can be increased or decreased by extending or contracting the actuator 20.

Figure 3A:
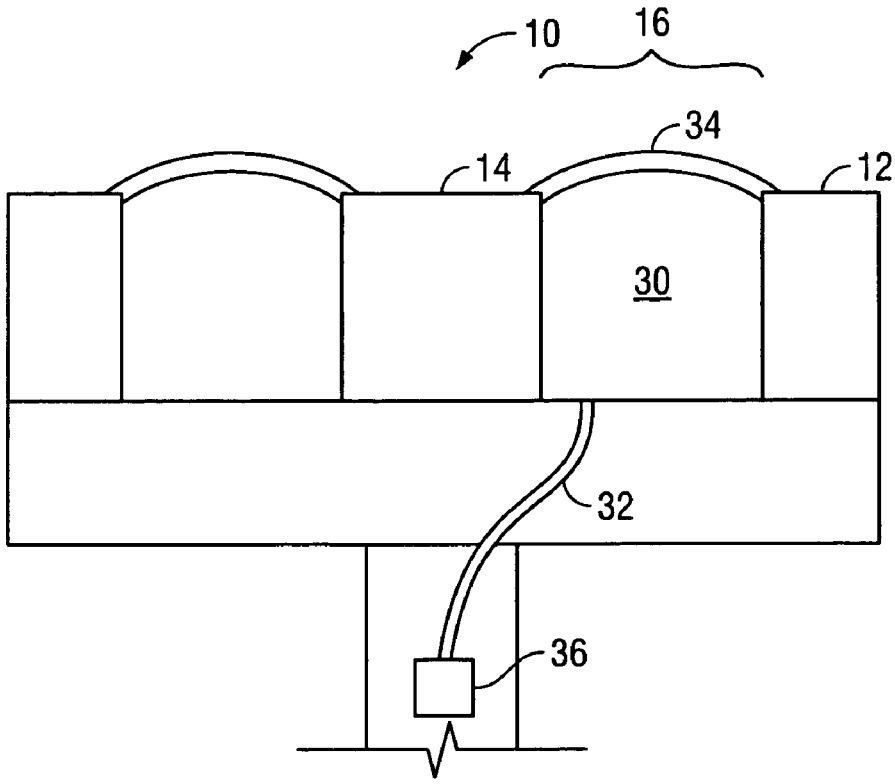
FIGS. 3A and 3B are schematic cross-sectional side views of a platen with pneumatically adjustable surface.

In another implementation, shown in FIG. 3A, the platen 10 includes a pneumatic support structure such as a pressurized chamber 30. The chamber 30 can be located underneath the middle region 16, which can be formed by a flexible membrane 34 that seals the pressurized chamber 30. The edges of the flexible membrane 34 can be attached to the adjacent regions 12, 14 of the platen 10. The pressure within the chamber 30 can be created by forcing a fluid, typically a gas such as air, into our out of the chamber. As the pressure within the chamber 30 increases, the membrane 34 can become distended, rising the most near the center of the membrane 34 and rising less near the ends of the membrane 34. The chamber 30 can be connected by tubing or passages 32 to pressure control elements 36, such as valves, pumps, pressure lines, vacuum lines, and pressure regulators. Alternatively, the pressure control elements can be located inside the platen. The chamber 30 is pressurized so that the pressure at the center of the membrane 34 is greater than the pressure at the adjacent regions 12, 14. The difference in pressure between the middle region 16 and the adjacent regions 12, 14 can be adjusted by adjusting the amount of fluid in the chamber.

Figure 3B:
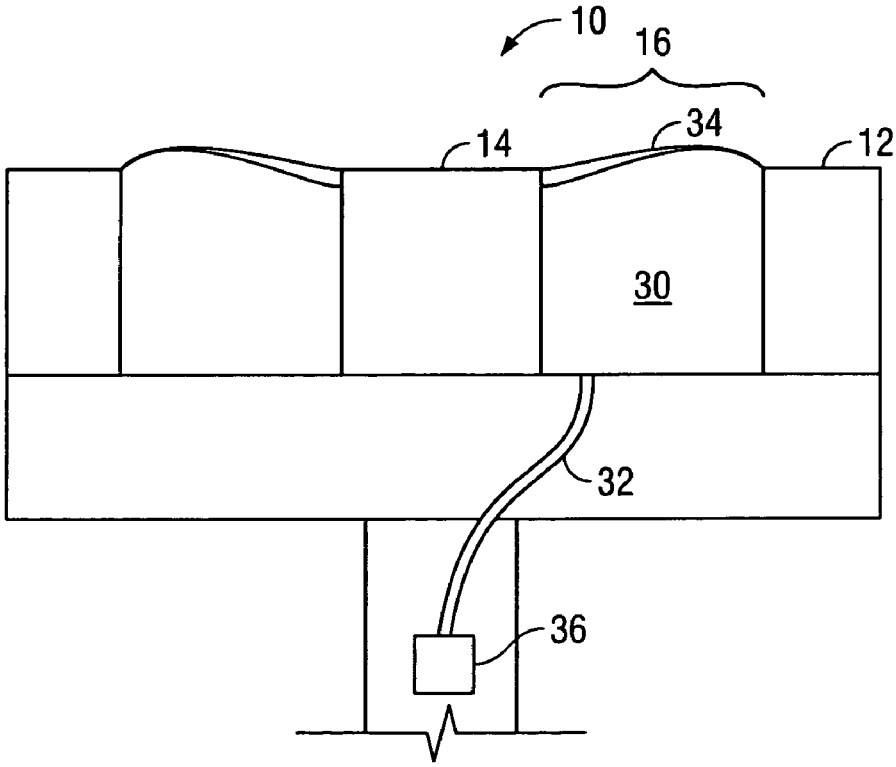

In FIG. 3A, the membrane 34 is shown having a uniform thickness. Alternatively, the membrane 34 can have portions of varying thickness. For example, one portion of the membrane can be thicker than another portion of the membrane, as depicted in FIG. 3B. In such cases, the thicker portion of the membrane rises less than the thinner portions of the membrane. The thicker portion of the membrane can be located radially outside or radially inside the thinner portion of the membrane.

Figure 4A:
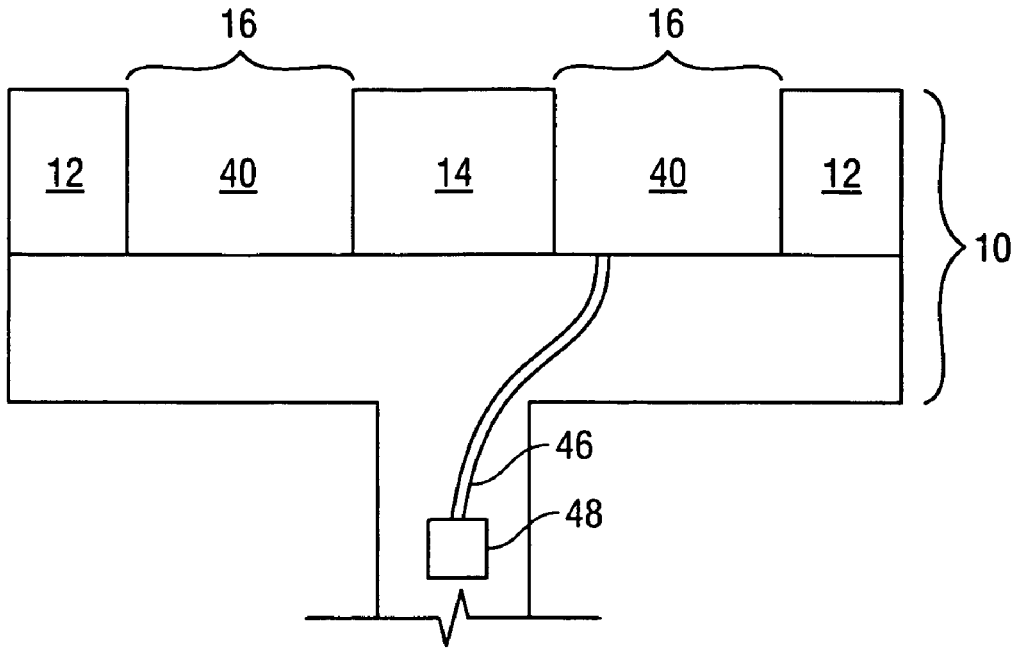
FIG. 4A is a cross-sectional side view of a platen having a grooved surface.
Figure 4B:
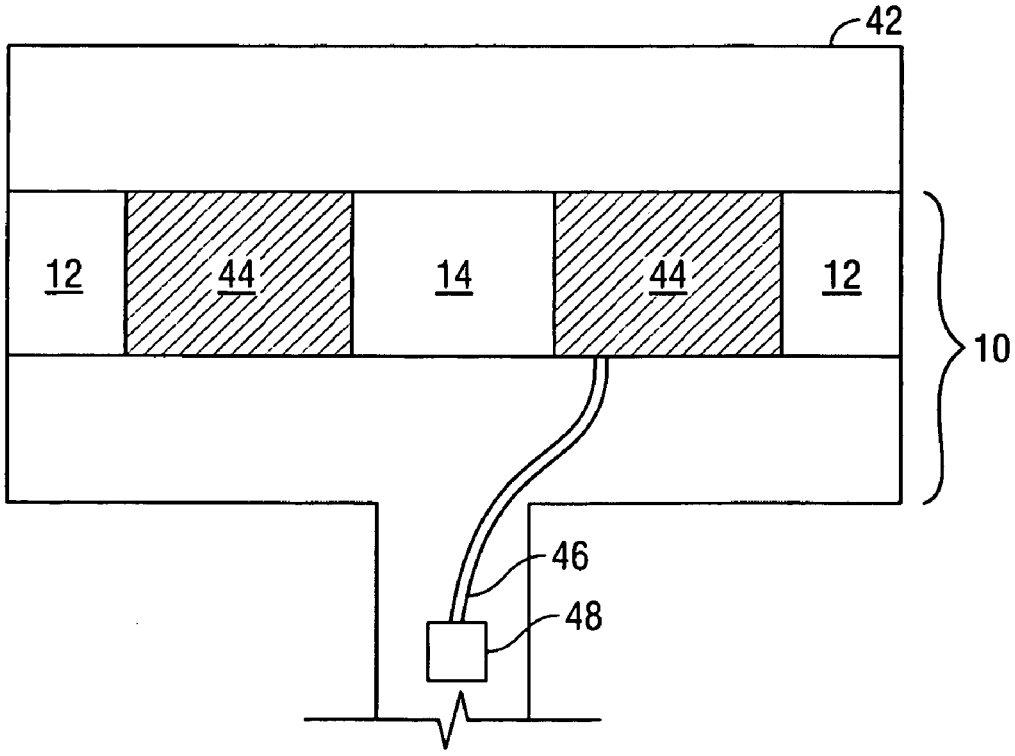
FIG. 4B is a cross-sectional side view of a platen having a grooved surface and covered by a polishing pad.

In yet another implementation, shown in FIGS. 4A and 4B, the middle region 16 of the platen's 10 surface contains a recess or groove 40. The groove 40 is open at the top, but the placement of a polishing pad 42 over the platen 10 completely covers and seals the opening of the groove 40 to form a pressurizable chamber 44. The polishing pad 42 needs to be sufficiently flexible that it will undergo some distortion in response to the pressure in the chamber 44. The thickness and composition of the polishing pad 42 can affect the pad's flexiblity. Also, the width of the groove 40 can affect the amount of pressure that is produced within the pressurized chamber 44. In one implementation, the polishing pad is formed of a porous polyurethane material measuring 0.05 inches thick and the pad completely covers a groove that measures 0.1 inches wide. The level of pressure in the chamber 44 can be controlled, e.g., by pressure control elements 48, such as valves, pumps, pressure lines, vacuum lines, and pressure regulators that are connected to the chamber 44 by a passage or tubing 46. Changing pressure in the chamber 44 proportionally changes the force by which the portion of the polishing pad covering the groove is pressed against the substrate.

Figure 5:
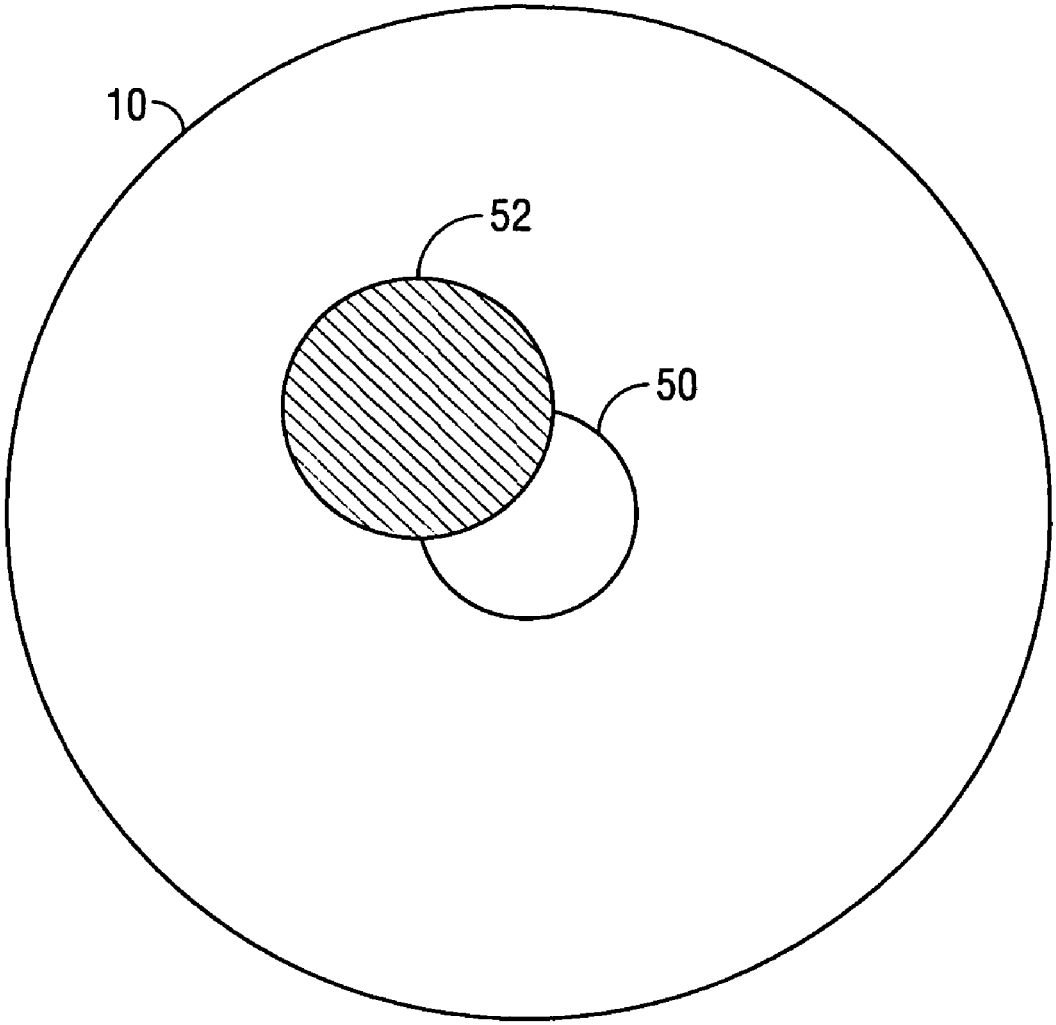
FIG. 5 is a schematic top view illustrating a possible location for the groove relative to the substrate.

The number of grooves, the location of each groove, and the location of the substrate relative to the grooves can be varied to produce different polishing profiles. For example, FIG. 5 shows a single circular groove 50 located near the center of the platen 10. A polishing pad (not shown) covers the groove 50 and a substrate 52 is positioned on top of the polishing pad such that only the edge portion of the substrate 52 overlaps with the groove 50. With the groove 50 and the substrate 52 so positioned, more force can be exerted during polishing against the edge portion of the substrate 52 than against portions of the substrate which do not overlap with the groove 50.

Although specific implementations have been described herein, those skilled in the art will recognize that the implementations disclosed herein may be changed without deviating from the scope of the invention. For example, instead of having a grooved surface, the platen can have a ridged surface formed by attaching a rigid ring to the surface of the platen.

What is claimed is:

1. A chemical mechanical polishing apparatus comprising:

a platen including:

a surface upon which a polishing pad can be secured in place, the surface having a first region and a second region, the surface being operable to exert force against the polishing pad during polishing;

a support structure operable to cause the second region to exert more force than the first region; and a controller operable to adjust the amount of force that is exerted by the second region, wherein:

the second region is a groove;

the support structure is a pressurized chamber formed within the groove when the polishing pad is secured in place over the groove; and the controller is a valve operable to adjust the amount of pressure in the chamber.

2. The apparatus of claim 1, wherein:

the platen is configured to rotate during polishing.

3. The apparatus of claim 1, wherein:

the surface of the platen is circular in shape.

4. The apparatus of claim 1, wherein:

the polishing pad has edges that are attached to the platen.

5. A method, comprising:

securing in place a polishing pad on a platen, the platen having a first surface region and a second surface region, wherein the second surface region is a groove that forms a pressurized chamber when the polishing pad is secured in place over the groove;

using the platen to exert force against the polishing pad during polishing; and adjusting the force that is exerted by the second surface region such that the second region exerts more force than the first region.

6. The method of claim 5, wherein adjusting the includes:

adjusting the pressure within the pressurized chamber.

7. The method of claim 5, further comprising:

placing a substrate on the polishing pad; and adjusting the placement of the substrate relative to the second surface region.

8. The method of claim 6, wherein adjusting the pressure within the pressurized chamber includes adding fluid into the chamber.

9. The method of claim 8, wherein the fluid is gaseous.

10. The method of claim 8, wherein the fluid is air.

11. The method of claim 8, wherein adding fluid into the chamber includes using a valve to control the amount of fluid that is added to the chamber.

12. The apparatus of claim 1, wherein the pressure within the chamber is created by adding fluid into the chamber.

13. The apparatus of claim 12, wherein the fluid is gaseous.

14. The apparatus of claim 12, wherein the fluid is air.

15. The apparatus of claim 12, wherein the valve is operable to control the amount of fluid that is added to the chamber.

* * * * *